United States Patent [19]

Nakano et al.

[11] Patent Number: 4,719,162

[45] Date of Patent: Jan. 12, 1988

[54] ELECTROPHOTOGRAPHICALLY SENSITIVE MATERIAL FOR A LITHO PRINTING PLATE

[75] Inventors: Shiro Nakano; Tuyoshi Ozaki, both of Nichinan; Kenji Noguchi, Tokyo, all of Japan

[73] Assignee: Oji Paper Company, Ltd., Tokyo, Japan

[21] Appl. No.: 867,840

[22] Filed: May 28, 1986

[30] Foreign Application Priority Data

Nov. 4, 1986 [JP] Japan ..... 61-81985
Aug. 9, 1985 [JP] Japan ..... 60-174342

[51] Int. Cl.[4] ..... G03G 13/26
[52] U.S. Cl. ..... 430/49; 430/302
[58] Field of Search ..... 430/49, 54, 100, 103, 430/302

[56] References Cited

U.S. PATENT DOCUMENTS 3,951,060 4/1976 Crystal ..... 427/387
4,518,668 5/1985 Nakayama et al. ..... 430/54

FOREIGN PATENT DOCUMENTS 40-07332 4/1965 Japan .
47-47610 12/1972 Japan .
48-11902 4/1973 Japan .
50-96231 7/1975 Japan .

*Primary Examiner*—John L. Goodrow
*Attorney, Agent, or Firm*—Armstrong, Nikaido, Marmelstein & Kubovcik

[57] ABSTRACT

An electrophotographic litho printing plate material which has a high storage stability and is useful for providing litho printing plates having an enhanced high quality image-forming durability, an improved printing durability, and an excellent dimensional stability, comprises (A) a substrate sheet; (B) an intermediate coating layer comprising (a) wet ground white mica fine particles having an average size of 5 to 50 μm, (b) a waterproofing agent comprising an organic silane compound of the formula (1): $R_nSiX_{4-n}$ (1) wherein n=1 or 2, R=aliphatic, cycloaliphatic, aromatic or heterocyclic radical having 1 to 30 carbon atoms, at least one R being chemically reactive, and X=hydrolyzable substituent, and (c) a thermoplastic resin binder; and (C) a photoconductive coating layer containing photoconductive pigment particles and an electrically insulating polymeric binder.

6 Claims, No Drawings

ELECTROPHOTOGRAPHICALLY SENSITIVE MATERIAL FOR A LITHO PRINTING PLATE

BACKGROUND OF THE INVENTION

1. Field of the Invention

The present invention relates to an electrophotographically sensitive material for a litho printing plate. More particularly, the present invention relates to an improved electrophotographic litho printing plate material which is capable of being connected to a printing plate having a high resistance to deterioration in quality of printed images with the lapse of time, a reduced elongation, and a high printing durability.

2. Description of the Related Art.

Due to the development of small size offset printing machines and automation devices for such printing machines, the mainstream of light printing processes is concentrated on the offset printing method.

In the printing plate materials for the offset printing process, many approaches in research and development were made and various new materials were provided and have been practially utilized.

The offset printing plate material usually comprises a substrate sheet and a photoconductive layer provided on the substrate sheet. Especially, it is known that an electrophotographic litho printing plate material having a photoconductive layer containing, as a principal component of a photoconductive pigment, zinc oxide (ZnO) particles, is cheap and is easy to use in the preparation of the printing plate. Therefore, the mainstream of the offset printing plate is concentrated on the above-mentioned type of electrophotographic litho printing plate.

In the preparation of the electrophotographic litho printing plate, a photoconductive layer of a corresponding litho printing plate material is coronacharged, exposed to actinic radiation, and developed in a desired pattern of images, and the developed images fixed by using a platemaker.

Generally, the developing procedure is carried out by a dry-developing method wherein a mixture of a toner with a carrier consisting of, for example, iron powder is used as a carrier, or by a wet-developing method wherein a developing liquid consisting of a toner dispersed in an organic solvent, for example, is used.

The wet-developing method is advantageous in that the reproductivity of resultant images in an intermediate tone is excellent, the resolving power is excellent, the platemaking time is short, and no correcting procedure is necessary. Therefore, in preparation of the electrophotographic litho printing plate, the wet-developing method is most widely used.

The electrophotographic litho printing plate material must be not only adequate for the above-mentioned printing plate-producing method, and the resultant images exhibit a high quality, but also the resultant printing plate must exhibit an excellent printing property.

For example, the litho printing plate produced by the above-mentioned developing procedure must be provided with non-image portions which are capable of being fat-desensitized. Also, in the electrophotographic litho printing plate, when the photoconductive layer surface which has been exposed to an actinic radiation and then developed is treated with an etching liquid, the non-image portions of the developed photoconductive layer must be capable of being made hydrophilic. Furthermore, as the printing plate surface is brought into contact with a large amount of water during the printing procedure, the plating plate must have a high resistance to water.

In consideration of the above-mentioned requirements, it has been attempted to provide an intermediate layer between the substrate sheet and the photoconductive layer to enhance the water-resistance of the printing plate.

Generally, the intermediate layer of the electrophotographic litho printing plate material is required to provide the following properties.

(1) high barrier property (2) excellent resistance to solvent for photoconductive layer, (3) excellent resistance to water, (4) proper electric resistivity of from $1\times10^9$ to $9\times10^{11}$ Ω-cm at a temperature of 20° C. at a relative humidity (RH) of 65%.

Usually, a high organic solvent resistance causes the printing plate to exhibit a poor water resistance, and a high water resistance causes the printing plate to exhibit a poor organic solvent resistance. Therefore, it is necessary that the printing plate exhibit a well balanced and proper water resistance and organic solvent resistance. To attain this balance, there are various approaches. For example, a conventional intermediate layer in the electrophotographic litho printing plate material may contain a water-proofing agent and a matrix binder. The matrix binder usually consists essentially of a water-soluble polymer, for example, polyvinyl alcohol, casein or starch. The water-proofing agent consists, for example, of a polyamino resin. The water-soluble polymer may be made water-insoluble by cross-linking the water-soluble polymer with the polyamino resin through a cross-linking agent. The matrix binder may be formed from a mixture of an aqueous solution of the above-mentioned watersoluble polymer and an aqueous emulsion of a synthetic water-insoluble polymeric material.

When the cross-linked polymer material is used to provide the intermediate layer, if the cross-linking reaction is carried out in an intermediate layer-forming paint liquid before the paint liquid is applied to a substrate, the viscosity of the paint liquid is increased and then the liquid is gelled, so that the paint liquid becomes useless for practical application. If it is attempted to carry out the cross-linking reaction during or after the application of the paint liquid to the substrate, it is necessary to heat the resultant paint liquid layer at a temperature of 150° C. or more for 5 minutes or more. These heating conditions are, however, not applicable to an actual process for producing the intermediate layer, in consideration of the productivity and commercial profit of the process.

Also, if above-mentioned high temperature and the above-mentioned long time are applied, the substrate will be deteriorated and, therefore, it becomes impossible to obtain a litho printing plate having the necessary mechanical and physical strength.

That is, the heating temperature and time expected from usual coating conditions are unsatisfactory to complete the cross-linking reaction. Therefore, the resultant intermediate layer exhibits an unsatisfactory water-proofing property, and then the resultant litho printing plate exhibits an unsatisfactory durability for the printing procedure.

Also, when a hydrophilic substance is contained in an intermediate layer of an electrophotographic litho printing plate, the resultant intermediate layer exhibits a poor bonding property to a photoconductive layer containing a hydrophobic bonding material.

Japanese Examined Patent Publication No. 47-47610 for Ricoh Co. discloses an intermediate layer-forming paint liquid consisting of a polyvinyl resin containing a functional monomer, for example, hydroxyethyl acrylate, and an amino resin. In this type of paint liquid, the reaction of the functional groups in the polyvinyl resin with the amino resin is carried out slowly, the resultant printing plate exhibits a poor water-proofing property and a poor decay of light in the image-forming procedure, and therefore, the resultant images are spoiled by serious blushing and poor contrast.

Also, Japanese Examined Patent Publication No. 40-7332 for Iwasaki Tsushinki discloses a printing plate in which a surface of a substrate is coated with a hydrophilic polymeric material layer and a coating layer, consisting of a synthetic polymeric resin soaked or swollen with a solvent for photoconductive coating layer, is formed between the hydrophilic polymeric material coating layer and the photoconductive coating layer.

In this type of printing plate, the added step for forming the hydrophobic coating layer between the hydrophilic polymer material coating layer and the photoconductive coating layer increases the cost of the resultant printing plate and the hydrophobic coating layer exhibits a bad influence on the decay of light on the photoconductive coating layer.

Japanese Examined Patent Publication No. 48-11902 for Ricoh Co. discloses an intermediate layer-forming paint liquid containing a synthetic resin emulsion, a hydrophilic polymer material and a water-proofing agent, for example, glyoxal, urea-formaldehyde resin, and melamine-formaldehyde resin.

This type of intermediate layer exhibits an unsatisfactory water-proofing property. Also, the intermediate layer is disadvantageous in that glyoxal or formaldehyde in the water-proofing agent is isolated from the intermediate layer with the lapse of time, the isolated glyoxal or formaldehyde is absorbed by zinc oxide particle surfaces in the photoconductive coating layer so that the photoconductive coating layer is degraded, and this phenomenon causes the photoconductive coating layer to exhibit a decreased oxygen-reabsorption after radiation exposure, and a degraded exposure property.

Japanese Unexamined Patent Publication No. 50-96231 for Canon Co. discloses a photoconductive coating layer containing a silane coupling agent. This is to enhance the durability in the printing process of the resultant printing plate by improving the photosensitivity of a duplicating photosensitive material and the bonding property of a photoconductive coating layer and a substrate. However, it was not at all known before the present invention to add a silane coupling agent to an intermediate coating layer.

SUMMARY OF THE INVENTION

An object of the present invention is to provide an electrophotographic litho printing plate material which can be converted to a printing plate capable of producing high quality printed images without degradation thereof with the lapse of time.

Another object of the present invention is to provide an electrophotographic litho printing plate material which can be converted to a printing plate having an enhanced printing durability and a reduced elongation.

The above-mentioned objects can be attained by the electrophotographic litho printing plate material of the present invention which comprises (A) a substrate sheet; (B) an intermediate coating layer formed on a surface of the substrate sheet and comprising (a) white mica (muscovite) fine particles which have been prepared by means of a wet-grinding method and have an average particle size of from 5 to 50 μm, (b) a water-proofing agent comprising at least one organic silane compound of the formula (1):

$$R_nSiX_{4-n} \quad (1)$$

wherein n represents an integer of 1 or 2, R represents a member selected from the group consisting of aliphatic, cycloaliphatic, aromatic and heterocyclic radicals containing 1 to 30 carbon atoms, at least one R radical represented by being chemically reactive, and X represents a hydrolyzable substituent, and (c) a thermoplastic resin binder; and (C) a photoconductive coating layer formed on the intermediate coating layer and containing photoconductive pigment particles and an electrically insulating polymeric binder.

DESCRIPTION OF THE PREFERRED EMBODIMENTS

The electrophotographic litho printing plate material of the present invention comprises a substrate sheet, an intermediate coating layer formed on a surface (an upper surface) of the substrate sheet and a photoconductive coating layer formed on the intermediate coating layer.

The substrate sheet usable for the present invention consists essentially of paper, a laminate sheet composed of a paper sheet laminated with an aluminum foil or a polyethylene film, or a paper-like synthetic polymer sheet. Usually, the substrate sheet has a thickness of, for example, from 100 to 170 μm.

The photoconductive coating layer usable for the present invention comprises photoconductive pigment particles and a electrically insulating polymeric binder.

The photoconductive pigment usually consists of at least one member selected from zinc oxide and titanium dioxide.

The electrically insulating polymeric binder usually consists of at least one hydrophilic polymeric material selected from acrylic ester copolymers, methacrylic ester copolymers, vinyl acetate copolymers, silicone resins, and butyral resins which are effective for preventing scumming on the background of images during the printing procedure.

The above-mentioned copolymers or resins contain, as the functional comonomer, acrylic acid, methacrylic acid, maleic acid or itaconic acid, to enhance image quality, coating property of the paint liquid, and mechanical strength of the photoconductive coating layer.

The photoconductive coating layer may contain a photosensitizing coloring material (dye).

In the electro-photographic litho printing plate material of the present invention, a specific intermediate coating layer is formed between the substrate sheet and a photoconductive coating layer. The intermediate coating layer comprises wet-ground white mica particles having an average particle size of from 5 to 50 μm, preferably, from 5 to 40 μm, more preferably from 10 to 40 μm, a specific waterproofing agent, and a specific polymeric binder.

The average particle size of the white mica particles can be determined by using a light-transmission type particle size distribution meter, for example, light-transmission type particle size distribution meter SKN-1000 (trademark, made by Seishin Kigyo Co.).

The intermediate coating layer of the present invention is highly effective for improving the quality of the resultant printed images, for enhancing the printing durability of the resultant printing plate, and for decreasing the elongation of the printing plate.

The white mica particles usable for the present invention have a general chemical composition of $$K_2O \cdot 3Al_2O_3 \cdot 6SiO_2 \cdot 2H_2O$$

A similar pigment to the white mica is sericite clay, which exhibits a silk-like gloss when wetted with water. Therefore, the sericite clay is a so-called silk mica. The white mica and sericite (silk mica) have chemical compositions as shown in Table 1.

TABLE 1

| Item | CHEMICAL COMPOSITION Sericite (Silk Mica) | White mice |
|---|---|---|
| $SiO_2$ | 48.9 | 45.57 |
| $Al_2O_3$ | 32.7 | 36.72 |
| $K_2O$ | 7.5 | 8.81 |
| MgO | 1.0 | 0.38 |
| CaO | 0.9 | 0.21 |
| $Fe_2O_3$ | 0.8 | 0.95 |
| $Na_2O$ | 0.2 | 0.62 |
| $SiO_2/Al_2O_3$ | 1.49 | 1.24 |

Table 1 clearly shows that in a comparison of the white mica with the silk mica, the white mica has a small ratio of contents of $SiO_2$ to $Al_2O_3$ and a large content of $K_2O$.

However, a most important difference of the white mica from the silk mica resides in that the raw ore of the silk mica (sericite clay) is in the form of fine particles having an average size of from 0.5 to 1.5 μm, and most of the silk mica available on the market is in the form of very fine particles having an average size of about 0.5 μm, whereas the raw ore of the white mica is in the form of coarse particles and, therefore, the size of the pulverized white mica can be easily controlled to a desired value of from several μm to several tens of μm by means of pulverizing and screening.

The white mica exhibits a higher cleavage property than that of the silk mica and the pulverized white mica is in the form of scale-shaped particles.

The white mica particles are prepared by means of a wet-grinding method which is effective for producing white mica particles having an even size.

In the present invention, it is important that the intermediate layer contains white mica particles in the form of scale-shaped particles and having an average size of 5 to 50 μm.

If the silk mica particles having a very small size of, for example, about 0.5 μm, are used in place of the white mica particles, the resultant intermediate coating layer exhibits an unsatisfactory water resistance (cobb size test) and, therefore, the resultant printing plate exhibits a poor printing durability and a large elongation.

In the intermediate coating layer of the present invention, the scale-shaped particles of the white mica having a relatively large size are arranged in parallel order so that the formation of undesirable voids in the coating layer is very small. Therefore, the intermediate coating layer exhibits an enhanced water-resistance (cobb-size test) and the resultant printing plate exhibits an enhanced printing durability and a reduced elongation.

When the average size of the white mica particles is smaller than 5 μm, the resultant intermediate coating layer exhibits an undesirable poor water resistance. Also, when the white mica particles have an average size of more than 50 μm, the white mica particles rapidly precipitate in the paint liquid and filtration of the paint liquid becomes difficult because a filter cloth is frequently choked by the large particles of white mica.

Generally, fine solid particles having a uniform size can be produced by means of a wet grinding method or dry grinding method. The white mica particles should be produced by the wet grinding method. If the dry grinding method is applied, the size of the resultant white mica particles varies widely and contains fine-fiber shaped particles, the resultant intermediate coating layer exhibits an unsatisfactory water resistance, and the resultant printing plate exhibits an undesirable large elongation.

The white mica particles prepared by the wet grinding method have a uniform size and are free from fiber-shaped fine particles, and therefore, the resultant intermediate layer does not have a rough structure which is caused by the fiber-shaped fine white mica particles, and exhibits an enhanced covering property for the substrate sheet and an increased water resistance.

If the white mica is excessively ground to provide fine particles having a similar size to that of the silk mica, the resultant fine particles containing fine fiber-shaped particles of white mica cause the formation of a rough structure in the intermediate coating layer, and the resultant printing plate exhibits a poor water resistance.

It is preferable that the content of the white mica particles in the intermediate coating layer be in the range of from 30% to 70% by weight, more preferably from 40% to 60% by weight.

In the intermediate coating layer of the present invention, the specific water-proofing agent comprises at least one organic silane compound of the formula (1):

$$R_nSiX_{4-n} \quad (1)$$

wherein n represents an integer of 1 or 2, R represents a aliphatic, cycloaliphatic, aromatic or heterocyclic organic radical having 1 to 30 carbon atoms, at least one radical represented by R being chemically reactive, and X represents a hydrolyzable substituent.

In the formula (1), the chemically reactive organic radical represented by R is selected preferably from, for example, vinyl radical, glycidyl radical, mercapto radical, amino radical, epoxy radical, halogen atoms, ester radical, and alkyl radicals having at least one selected from the above-mentioned radicals and atoms. Another organic radical represent by R is selected from aliphatic radicals, for example, N-β(aminomethyl)-γ-aminopropyl and γ-methacryloxypropyl radicals; cycloaliphatic radicals for examples, γ-anilinopropyl radical; aromatic radicals for example, N-β(N-vinyl-benzylaminoethyl)-γ-aminopropyl radical; and heterocyclic radicals, for example octadecyldimethylammonium chloride.

In the formula (1), the hydrolyzable substituent represented by X is selected preferably from halogen atoms, amino radical, hydroxy radical and alkoxy radicals having 1 to 4 carbon atoms.

The organic silane compound of the formula (1) is highly effective not only as a waterproofing agent but also as an organic solvent-proofing agent. This specific properties of the organic silane compound are derived from the fact that the chemically reactive radical, for example, amino radical, vinyl radical, epoxy radical, mercapto radical or a halogen atom in the silane compound reacts with a synthetic resin and hydrophilic polymeric resin, for example, casein, so as to form cross-linkages between the resinous polymeric molecules and the make the intermediate coating layer water resistant, and the hydrolyzable substituent, for example, methoxy or, ethoxy radical, in the silane compound is hydrolyzed to a corresponding silanol radical, and the resultant silanol compound condensation reacts with the synthetic resin and the hydrophilic polymeric resin so as to form cross-linkages. That is, the above-mentioned crosslinking reactions cause the resultant intermediate coating layer to exhibit an enhanced waterproofing property.

The organic silane compound is contained, preferably in a content of from 1 to 15% by weight, more preferably, from 5 to 10% by weight, in the intermediate coating layer.

In the intermediate coating layer, the thermoplastic resin binder preferably comprises, as a principal component, at least one copolymer of an ester comonomer selected from acrylic esters and methacrylic esters with a nitrile comonomer selected from acrylonitrile and methacrylonitrile.

The ester comonomer is preferably selected from alkyl acrylates, for example methyl acrylate, ethyl acrylate, butyl acrylate and 2-ethylhexyl acrylate, and alkyl methacrylates, for example, methyl methacrylate, ethyl methacrylate, butyl methacrylate and glycydil methacrylate.

In the specific copolymer mentioned above, the copolymerization molar ratio of the ester comonomer to the nitrile comonomer is preferably in the range of from 20:80 to 80:20. If the amount of the nitrile comonomer is more than 80 molar %, the resultant copolymer may exhibit an unsatisfactory film-forming property and an excessive high resistance to organic solvent, which excessively high resistance causes the resultant intermediate coating layer to have an unsatisfactory bonding property to the photoconductive layer and the resultant printing plate to exhibit a poor printing durability. Also, if the nitrile comonomer is in an amount of less than 20 molar %, this results in a decreased solvent resistance of the resultant intermediate coating layer. This decreased solvent resistance sometimes causes a solvent used in the photoconductive coating layer-forming paint liquid to remain in the intermediate coating layer or the photoconductive coating layer-forming paint liquid to exhibit an unsatisfactory coating property.

The content of the above-mentioned specific copolymer in the binder is preferably in the range of from 20% to 100% by weight, more preferably from 30% to 100% by weight.

The above-mentioned specific copolymer is highly effective for enhancing the resistance to organic solvent and the mechanical strength of the resultant intermediate coating layer and for improving the printing durability of the printing plate and the optical density of the printed images.

The thermoplastic resin binder may contain, in addition to the above-mentioned specific ester-nitrile copolymer, 20% by weight or less of at least one additional thermoplastic polymer selected from, for example, polyacrylic esters, polymethacrylic esters, polyvinyl chloride, polyvinylidene chloride, polyvinyl acetate, polyurethane, polyacrylonitrile, polyacrylonitrile polybutadiene, and polyestyrene.

In the intermediate coating layer of the present invention, the thermoplastic resin binder is contained preferably in a content of 20 to 60% by weight.

The intermediate coating layer of the present invention may contain, in addition to the white mica particles, the specific waterproofing agent and the thermoplastic resin binder, 20% by weight or less of at least one member selected from inorganic fillers, for example, clay, talc, calcium carbonate, and silica, and water-soluble polymeric materials, for example, starch, its derivatives, cellulose derivatives, polyvinyl alcohol, casein, and vinyl acetate-maleic anhydride copolymers.

The intermediate coating layer is preferably in an amount of from 5 to 15 g/m$^2$, more preferably from 5 to 10 g/m$^2$.

The electrophotographic litho printing plate material of the present invention may contain an additional electroconductive coating layer formed on the lower surface of the substrate sheet. The additional electroconductive coating layer contains an electroconductive material comprising at least one member selected from, for example, quaternary ammonium polymeric compounds, for instance, polydiallyldimethyl ammonium chloride, and polyvinyl dimethyl ammonium chloride, and electrolytic polymeric compounds, for instance, polyacrylic acid sodium salt, polystyrene sulfonic acid sodium salt, and polystyrene sulfonic acid ammonium salt; a polymeric binder comprising at least one polymeric resin selected, from, for example, polyvinyl alcohol, polyvinyl acetate, polyacrylic resins, and styrene-butadiene copolymer resins. Usually, the amount of the electroconductive coating layer is preferably in the range of 5 to 15 g/m$^2$.

The electrophotographic litho printing plate material of the present invention is produced by coating a surface of a substrate sheet with a paint liquid containing the necessary components for the intermediate coating layer and a solvent, by drying the resultant paint liquid layer on the substrate sheet, by coating the dried intermediate coating layer surface with a paint liquid containing the necessary components for the photoconductive coating layer and a solvent, for example, ethyl acetate, butyl acetate, toluene or xylene, and by drying the resultant paint liquid layer to form the photoconductive coating layer.

The thermoplastic resin binder for the intermediate coating layer is usually mixed in the state of an aqueous emulsion with the remaining components.

The specific examples presented below will serve to more fully elaborate the ways in which the present invention can be practically used. However, it should be understood that the examples are only illustrative and in no way limit the scope of the present invention.

EXAMPLE 1

An electrophotographic litho printing plate material was produced by the following steps.

(1) An upper surface of a substrate sheet of paper having a thickness of 110 μm and a basis weight of 100 g/m$^2$ was coated by means of a usual size-press method with a dry weight of 2 g/m$^2$ of a barrier coating layer having the following composition.

| Component | Amount (part by dry weight) |
|---|---|
| Polyvinyl alcohol | 80 |
| Polyacrylic acid sodium salt | 20 |

(2) The surface of the resultant barrier coating layer was coated with an intermediate coating layer-forming paint liquid having the following composition.

| Component | Amount (part by weight |
|---|---|
| White mice particles*1 | 40 |
| Copolymer aqueous emulsion*2 | 40 |
| Casein aqueous solution (10%) | 10 |
| Silane coupling agent*3 | 10 |

Note:
*1Average size: 20 μm Manufacturer: Yamaguchi Mica Co.
*2Copolymer of 20 molar % of methyl methacrylate with 20 molar % of butyl acrylate and 60 molar % of acrylonitrile. Concentration: 45%
*3Trademark: SH6040, made by Toray Silicone Co.

The resultant paint liquid layer was solidified by drying to provide an intermediate coating layer having a dry weight of 10 g/m$^2$.

(3) The surface of the intermediate coating layer was coated with a photoconductive coating layer-forming paint liquid having the following composition.

| Component | Amount (part by weight) |
|---|---|
| Photoconductive zinc oxide*4 | 100 |
| Silicone resin*5 | 30 |
| Rose Bengal | 0.1 |
| Toluene | 150 |

Note:
*4Trademark: SAZEX2000, made by Sakai Chemical Co.
*5Trademark: KR-211, made by Shinetsu Chemical Co.

The resultant paint liquid layer was dried to provide a photoconductive coating layer with a weight of 25 g/m$^2$.

(4) The lower surface of the substrate sheet was coated with an additional electroconductive coating layer-forming paint liquid having the following composition.

| Component | Amount (part by weight) |
|---|---|
| Polyvinyl alcohol*6 | 30 |
| Polyvinyl acetate resin*7 | 50 |
| Quaternary ammonium type Polymeric electroconductive material*8 | 20 |

Note:
*6Trademark: T-330, made by Nippon Gosei Chemical Co.
*7Trademark: Cevian A-522, made by Daicel Co.
*8Trademark: Chemistat 5500, made by Sanyo Chemical Co.

The resultant electroconductive coating layer was in a dry weight of 8 g/m$^2$.

The resultant electrophotographic litho printing plate material was conditioned in a dark room at a temperature of 25° C. at a relative humidity of 50% for 24 hours, and then was converted to a printing plate with a desired pattern of images by means of an ordinary platemaker (Itek Model 175, made by Itek Graphix Co.). The stability in image-forming property of the litho printing plate material with the lapse of time was evaluated by the following test.

A litho printing plate material was placed in a bag made from a black colored polyvinyl chloride sheet, and the litho printing plate material-containing bag was sealed and left at a temperature of 35° C. for one month. Thereafter, an ordinary pre-exposure operation was applied to the litho printing plate material at an illuminance of 1000 lux for 10 seconds. The charging property of the pre-exposed photoconductive coating layer was measured by means of EPA (made by Kawaguchi Denki Co.). Thereafter, the litho printing plate material was converted to a litho printing plate by the ordinary method by means of an Itek Model 175 platemaker.

Separately, the charging property of the original litho printing plate material was measured before the stability test by the same procedures as mentioned above.

The results are shown in Table 2.

The resultant litho printing plate was subjected to a printing test wherein the plate was fat-desensitized with an etching solution of Itek Co. and was set on an offset printing machine (Trademark: Hamada 700CD, made by Hamada Printing Machine Co.); the printing ink used was New Champion F Gloss (Black). The printing durability and elongation of the printing plate was determined. The results are shown in Table 2.

EXAMPLE 2

The same procedures as those described in Example 1 were carried out except that the paint liquid for the intermediate coating layer had the following composition.

| Component | Amount (Part by weight) |
|---|---|
| White mica*9 | 40 |
| opolymer emulsion*10 | 40 |
| Casein aqueous solution (10%) | 10 |
| Silane coupling agent*11 | 10 |

Note:
*9Average size: 10 μm, made by Yamaguchi Mica Co.
*10 45% aqueous emulsion of a copolymer of a 30 molar % of methylmethacrylate with 30 molar % of ethylacrylate and 40 molar % of acrylonitrile
*11Trademark: SH6040, made by Toray Silicone Co.

The results are shown in Table 2.

COMPARATIVE EXAMPLE 1

The same procedures as those described in Example 1 were carried out except that in the intermediate coating layer, the white mica particles were replaced by Zeaclite Clay which was supplied by Zeaclite Industry Co. and contained 35% by weight of sericite (silk mica).

The results are shown in Table 2.

COMPARATIVE EXAMPLE 2

The same procedures as those described in Example 1 were carried out except that, in the paint liquid for the intermediate coating layer, the silane coupling agent was replaced by 10 parts by weight of glyoxal (made by Daicel Chemical Co.).

The results are shown in Table 2.

EXAMPLE 3

The same procedures as those described in Example 1 were carried out except that, in the intermediate coating layer-forming paint liquid, the copolymer emulsion was replaced by a 45% aqueous emulsion of a coplymer of 60 molar % of methyl methacrylate with 40 molar % of butyl acrylate.

The results are shown in Table 2.

TABLE 2

| Example No. | Charging property in pre-exposure: Before storage | Charging property in pre-exposure: After storage | Printing durability (Picking) (Number of copies) | Elongation of printing plate after 5000 copies: Longitudinal direction (%) | Elongation of printing plate after 5000 copies: Lateral direction (%) |
|---|---|---|---|---|---|
| Example 1 | Good | Good | 8000 | 0.10 | 0.20 |
| Example 2 | Good | Good | 7000 | 0.10 | 0.25 |
| Comparative Example 1 | Good | Good | 4000 | 0.50 | 0.60 |
| Comparative Example 2 | Good | Remarkably decreased | 4000 | 0.10 | 0.22 |
| Example 3 | Good | Very slightly decreased | 4000 | 0.10 | 0.25 |

Table 2 clearly shows that the printing plates of Examples 1 to 3 exhibited a satisfactory charging property even after storage for one month, excellent printing durability, and very small elongation. However, in Comparative Example 1 wherein the zeaclite clay was used in place of white mica particles in the intermediate coating layer, the resultant printing plate exhibited large elongations in the longitudinal and lateral directions thereof, in the other words, a poor dimensional stability.

Also, in Comparative Example 2 wherein glyoxal was used as a waterproofing agent in place of the silane coupling agent, the resultant printing plate material exhibited a significantly decreased charging property in the pre-exposure procedure after storage of one month, i.e., a poor storage stability.

We claim:

1. An electrophotographically sensitive material for a litho printing plate, comprising:

(A) a substrate sheet;

(B) an intermediate coating layer formed on a surface of the substrate sheet and comprising (a) white mica fine particles which have been prepared by means of a wet-grinding method and have an average particle size of from 5 to 50 μm, (b) a waterproofing agent comprising at least one organic silane compound of the formula (1):

$$RnSiX_{4-n} \quad (1)$$

wherein n represents an integer of 1 or 2, R represents a member selected from the group consisting of aliphatic, cycloaliphatic, aromatic and heterocyclic radicals containing 1 to 30 carbon atoms, at least one radical represented by R being a chemically reactive radical selected from the group consisting of vinyl, glycidyl, mercapto, amino, epoxy and ester radicals, halogen atoms and alkyl radicals having at least one substituent consisting of a member selected from the above-mentioned radicals and atoms, and X represents a hydrolyzable substituent selected from halogen atoms, amino radical, hydroxyl radical, and alkoxyl radicals having 1 to 4 carbon atoms, and (c) a thermoplastic resin binder; and (C) a photoconductive coating layer formed on the intermediate coating layer and containing photoconductive pigment particles and an electrically insulating polymeric binder.

2. The litho printing plate material as claimed in claim 1, wherein the white mica particles are in a content of from 30% to 70% by weight in the intermediate layer.

3. The litho printing plate material as claimed in claim 1, wherein the water-proofing agent is in a content of 1 to 15% by weight in the intermediate layer.

4. The litho printing plate material as claimed in claim 1, wherein the thermoplastic resin binder in the intermediate coating layer comprises at least one copolymer of an ester comonomer selected from acrylic esters and methacrylic esters with a nitrile comonomer selected from acrylonitrile and methacrylonitrile.

5. The litho printing plate material as claimed in claim 4, wherein the ester comonomer and the nitrile comonomer are in a molar ratio of from 20:80 to 80:20.

6. The litho printing plate material as claimed in claim 1, wherein the intermediate coating layer is an amount of 5 to 15 g/m$^2$.

* * * * *